United States Patent [19]

Hayashi et al.

[11] 4,449,707

[45] May 22, 1984

[54] GOLF CLUB HEAD OF CARBON FIBER REINFORCED PLASTIC

[75] Inventors: Keijiro Hayashi, Takatsuki; Toshimi Awano, Ohgaki; Masayuki Yoshikawa, Iwate; Kouzou Yazawa, Gifu; Takashi Ito, Ohgaki, all of Japan

[73] Assignee: Mizuno Corporation, Osaka, Japan

[21] Appl. No.: 496,640

[22] Filed: May 20, 1983

[30] Foreign Application Priority Data

May 22, 1982 [JP] Japan ..... 57-87137
Aug. 31, 1982 [JP] Japan ..... 57-152439

[51] Int. Cl.[3] ..... A63B 53/06
[52] U.S. Cl. ..... 273/171; 273/167 H
[58] Field of Search ..... 273/167 H, 169, 171, 273/172, 167 A, 167 F, 80.3, 80.2

[56] References Cited

U.S. PATENT DOCUMENTS 1,515,390 11/1924 Hubbard ..... 273/169 X
1,638,916 8/1927 Butchart ..... 273/169
3,266,805 8/1966 Bulla ..... 273/169 X
3,692,306 9/1972 Glover ..... 273/172 X
3,843,122 10/1974 Florian ..... 273/169 X
4,076,254 2/1978 Nygren ..... 273/171

FOREIGN PATENT DOCUMENTS 35-15505 6/1960 Japan .
50-9074 1/1975 Japan .

*Primary Examiner*—George J. Marlo
*Attorney, Agent, or Firm*—Fleit, Jacobson, Cohn & Price

[57] ABSTRACT

A golf club head comprises a shell of carbon fiber reinforced plastic having a core and a reinforcement of carbon fiber fabric embedded in the shell, the side and bottom of the shell are covered with a metal sole member including its integral side and sole portions, the core is positioned and retained in said shell by inserting a projection or projections on the sole member into the core and a pocket is provided in the sole member for containing weights to be used for weight adjustment of the head or balance adjustment.

4 Claims, 11 Drawing Figures

GOLF CLUB HEAD OF CARBON FIBER REINFORCED PLASTIC

The present invention relates to a golf club head made of carbon fiber reinforced plastic.

In general, natural material such as Japanese perismmon has been used for golf club heads, particularly wood heads. However, the use of the natural material is disadvantageous in that lots of time and labor are required to shape a piece of persimmon into golf club head and that the yield rate is low. There has also been a difficulty in obtaining persimmon trees because of their shortage. Such being the situation, there has been known a head made of glass fiber reinforced plastic (hereinafter referred to as GFRP) which is produced by stiffening glass fiber with polyester resin, as described in Japanese Utility Model Publication No. 35-15505. In the head made of GFRP, however, the high specific gravity of glass fiber results in an increase in the head weight. In order to reduce the head weight, a polyurethane core must have been embedded in GFRP of the head. The conventional method has disadvantages in that the core cannot be properly retained in a mold so that the core may be displaced to an undesired position due to a pressure applied through GFRP to the core and the fluidity of GFRP during its molding to be exposed to the head surface upon completion of molding and this results in a weakened portion of GFRP shell surrounding the core and having a non-uniform thickness throughout the head. An attempt has been made to reinforce the neck portion of the head by disposing fibers longitudinally and spirally therein but this process is most time-consuming, and besides, if the glass fibers of the longitudinal and spiral orientations were to have a failure in their rate, the neck portion of the head would not provide enough strength to resist bending, compressive or tensile stress caused by impact on the head at the time of hitting the ball. That is, in case the rate of longitudinally disposed fibers relative to spirally disposed fibers is high, the neck portion has higher resistance against bending force but it is liable to be broken because of having lower resistance to torsinal force. On the contrary, if the rate of spirally disposed fibers is higher than that of longitudinally disposed fibers, the neck portion has higher resistance against torsional force but lengthwise cracks are produced in the neck portion since it becomes weaker against bending force.

Japanese Utility Model Laid-Open Disclosure No. 50-9074 discloses a golf club head of carbon fiber reinforced plastic which has a lighter weight than the head made of GFRP because of the low specific gravity. Since the carbon fibers are large in diameter, the short fibers are not liable to be impregnated and mixed with synthetic resin to become bulky cakes which may disturb the molding operation. A club head which is formed from such a mixture by means of a mold, is insufficient in its strength since the rate of the carbon fiber in the mixture is limited to about 30%. As particularly in the neck portion of the head, its sufficient strength is not expected unless the rate of fibers in the mixture exceeds 60%, the neck portion is liable to be broken by impact at the time of hitting the ball. Further, the carbon fiber reinforced plastic containing the carbon fibers of about 30% and synthetic resin of about 70% results in reduction in the wear-resistance of the sole portion of the golf club head so that the sole portion is easily worn.

On the other hand, the club head formed from only the carbon fiber reinforced plastic causes the deflection of the head and irregular trajectory of the ball since the inertia moment of the head during hitting of the ball is reduced due to an improper center of gravity and unbalance of the head weight.

In the case of the fiber reinforced plastic head having its lighter weight, a weight adjustment of the head must be made by drilling the head and inserting weights into the drilled hole. Because of a difficulty in working or machining, however, the head may have cracks occured therein as well as a worse appearance.

A main object of the present invention is to provide a golf club head of carbon fiber reinforced plastic having a reinforcement of carbon fiber fabric surrounding a core properly embedded therein and extending into the neck portion of the head to strengthen the head and neck portions and a metal sole member which is fixedly secured to the shell without any mechanical screws and arranged to cover the side and the bottom of the head, thereby preventing it from wearing off.

Another object of the invention is to provide a golf club head wherein the provision is provided in the metal sole member for facilitating a weight adjustment or balance adjustment for improved trajectory of the ball.

According to the invention, there is provided a golf club head comprising a shell of carbon fiber reinforced plastic comprising carbon short fibers impregnated with synthetic resin, a core embedded in the shell to reduce the head weight, a reinforcement of carbon fiber fabric surrounding the core and extending into the neck portion of the head to strengthen the head and neck portions, a metal sole member including integral side and sole portions so arranged as to cover the side and the bottom of said shell, respectively, at least one projection of the metal sole member inserted into the core to position and retain the core in the shell, and pocket means in the metal sole member for containing weights to achieve the weight adjustment of the head or balance adjustment.

These and other objects and advantages of the invention will become more apparent from the following description of embodiments of the invention made, by way of example, with reference to the accompanying drawings in which.

Figure 1:
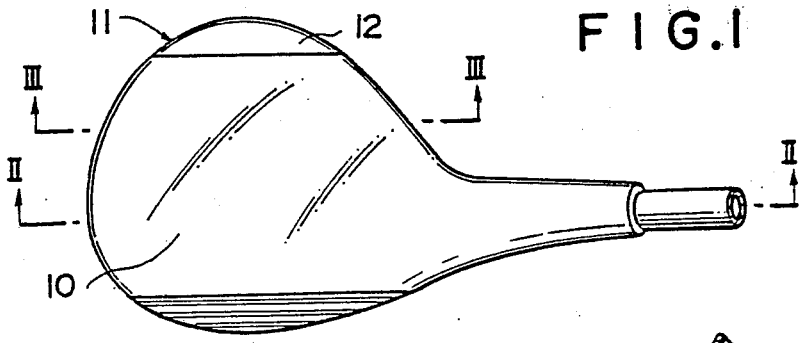
FIG. 1 is a top plan view of a golf club head according to the invention.
Figure 4:
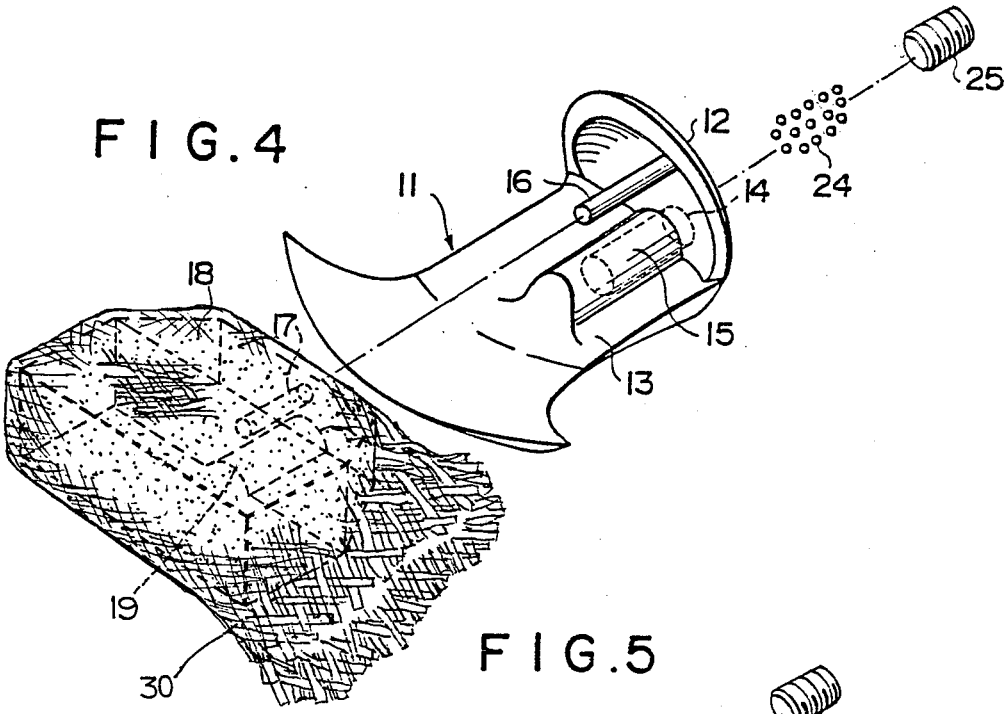
FIG. 4 is a perspective view of a metal sole member and a core forming a parts of the golf club head according to the invention.

Referring to FIG. 1 of the drawings, there is shown a golf club head 10 of carbon fiber reinforced plastic formed in accordance with the present invention. A metal sole member 11 includes a side portion 12 and a sole portion 13 formed integrally with each other as shown in FIG. 4. The sole member 11 is provided with a pocket 14 formed in a rising portion 15 on the sole portion 13 and opening laterally through the side portion 12. The sole member 11 is also provided with a projection 16 in a form of a pin extending inwardly of the side portion 12, which is inserted into a hole 17 formed in a core 18 of foamed polyurethane to position and retain the core 18 on the sole member 11. The core 18 is provided on its bottom with a recess 19 which is seated on the top of the rising portion 15.

Figure 2:
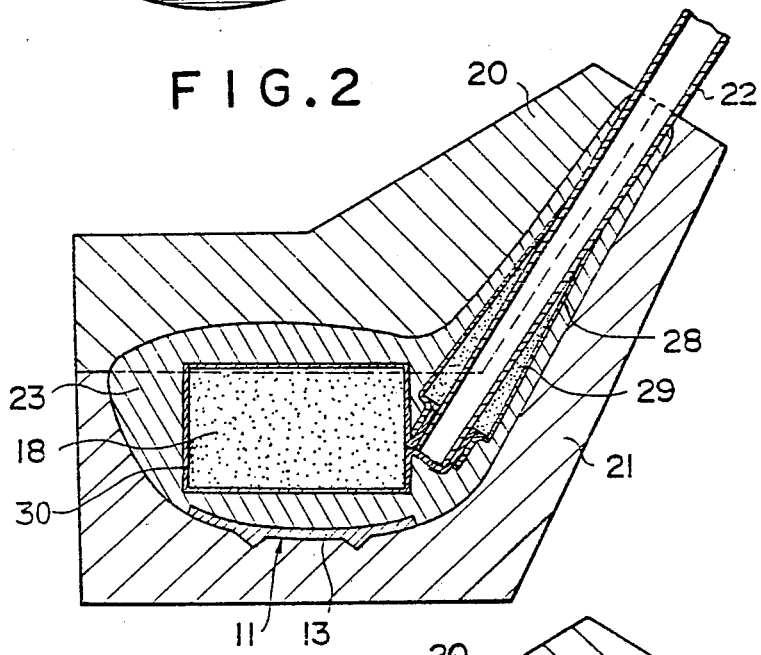
FIG. 2 is a cross-sectional view of a mold showing the molding of the golf club head according to the invention, and taken along a line corresponding to line II—II in FIG. 1.
Figure 3:
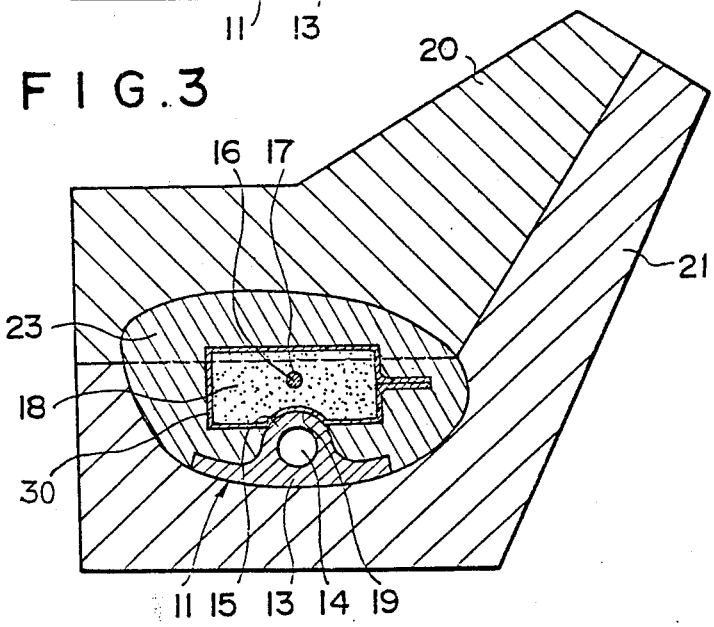
FIG. 3 is a view similar to FIG. 2, but taken along a line corresponding to line III—III in FIG. 1.
Figure 7:
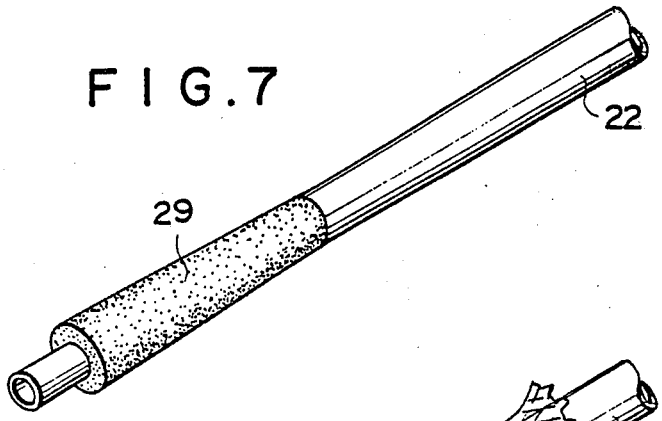
FIG. 7 is a perspective view of a mandrel having a tapered neck core fitted thereover.
Figure 8:
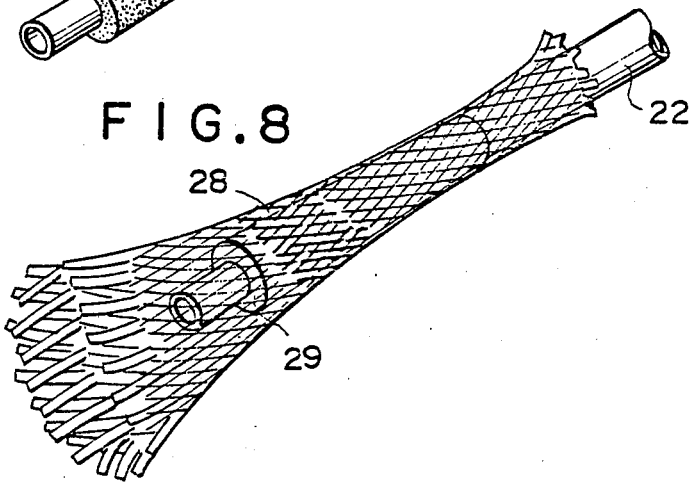
FIG. 8 is a perspective view of a fabric of carbon fibers surrounding the neck core on the mandrel.

As can be seen in FIGS. 2 and 3, a mold includes its upper and lower mold halves 20 and 21 and the sole member 11 with the core 18 positioned thereon together with a reinforcement of carbon fiber fabric 30 surrounding the core 18, is positioned in the lower mold half 21 which is then filled with carbon fiber reinforced plastic comprising short carbon fibers impregnated with synthetic resin while positioning a mandrel 22 in a position where the neck portion of the club head is formed. As can be best seen in FIG. 7, the mandrel 22 has an upwardly converging neck core 29 of foamed polyurethane fitted thereover and covered with a reinforcement of carbon fiber fabric 28 (see FIG. 8), the end of which is in overlapped relation with the end of the core reinforcement 30. It should be noted that the carbon fiber reinforced plastic is deposited around the reinforcements 30 and 28 on the core 18 and the mandrel 22. The upper mold half 20 is then placed on the lower mold half 21 so that the carbon fiber reinforced plastic is confined in a cavity defined between the upper and lower mold halves 20 and 21 to form a shell 23 of the golf club head 1 having the cores 18 and 29 and reinforcements 30 and 28 embedded therein. The mold is heated under pressure to mold the head.

The golf club head thus produced comprises the shell of carbon fiber reinforced plastic having the cores 18 and 29 and the reinforcements of carbon fiber fabrics 30 and 28 embedded therein and the metal sole. The core 18 is securely fixed in the center portion of the head 10 by inserting the projection 16 into the core 18. This prevents the core 18 from displacing in the mold due to the molding pressure and fluidity of the carbon fiber reinforced plastic during molding operation. Thus, the shell of the head has a predetermined thickness and strength throughout the head. The existance of the reinforcement of carbon fiber fabric around the head core results in a further increase in strength of the head body and the overlapped ends of the reinforcements will sufficiently strengthen the neck portion at its junction to the head body to resist impact stresses. The use of the neck core 29 makes it possible to decrease the weight of the neck portion of the head. Enlargement of the reinforcement 28 of carbon fiber fabric along the shape of the neck core 29 results in the neck portion having an enough uniform strength along the length thereof to resist the bending and torsional forces imposed on the neck portion of the head.

Preferably, the carbon fiber reinforced plastic forming the shell of the golf club head contains the short carbon fibers of more than 60% to provide a high strength of the golf club head.

Figure 5:
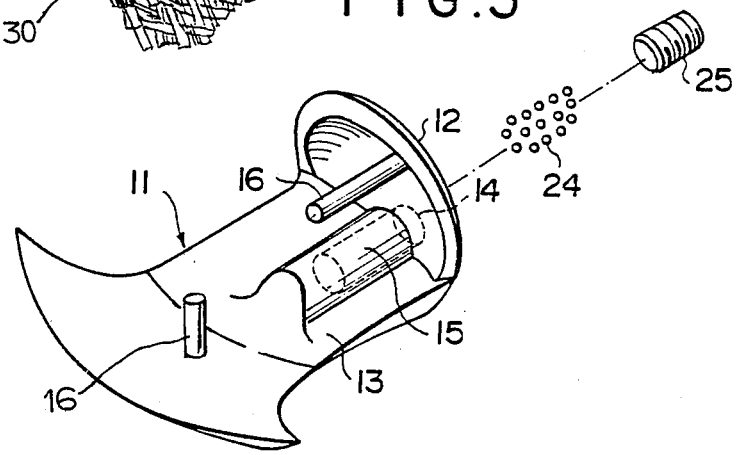
FIG. 5 is a view similar to FIG. 4 but showing another embodiment of the metal sole member.
Figure 6:
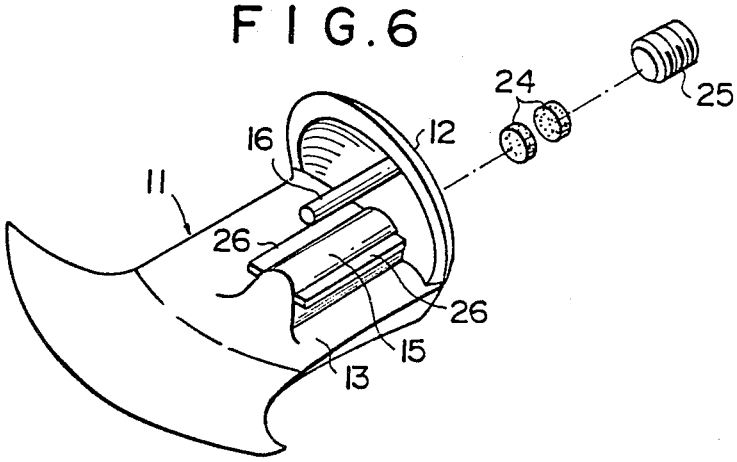
FIG. 6 is perspective view of further embodiment of the metal sole member.

FIG. 5 shows an embodiment of the metal sole member 11 having two projections 16, 16 extending inwardly and upwardly of the side and sole portions 12 and 13, respectively. The weight adjustment of the head 10 or swing balance adjustment after the head 10 has been attached to a shaft (not shown), can be achieved by selectively inserting weights 24 in the form of balls into the pocket 14 and closing it with a threaded plug 25 threadedly received in the opening of the pocket 14 inwardly of the side portion 12 thereof. The metal sole member 11 illustrated in FIG. 6 is similar to that illustrated in FIG. 5 except that projections 26 in the form of fins are horizontally formed on the rising portion 15 on its opposite sides to support the core 18.

Figure 9:
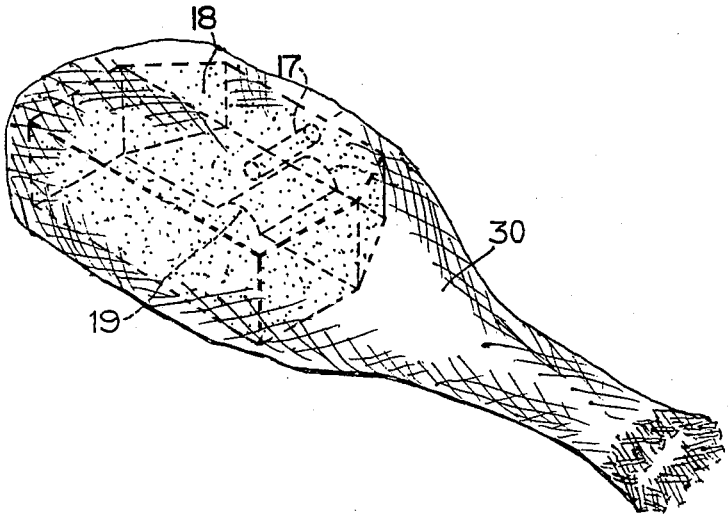
FIG. 9 is a view similar to FIG. 2 but showing the use of a reinforcement of carbon fiber fabric surrounding the head core and extending onto the mandrel.

As shown in FIG. 9, the reinforcement 30 of carbon fiber fabric may be of an enough length to extend into and be embedded integrally in the neck portion of the golf club head.

Figure 10:
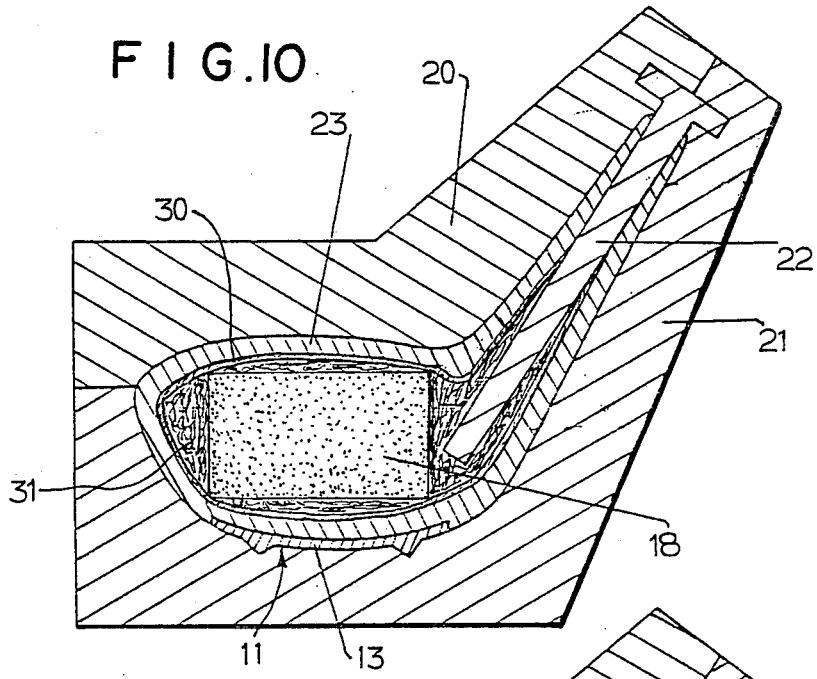
FIG. 10 is a view similar to FIG. 3 but showing the embodiment of FIG. 9.
Figure 11:
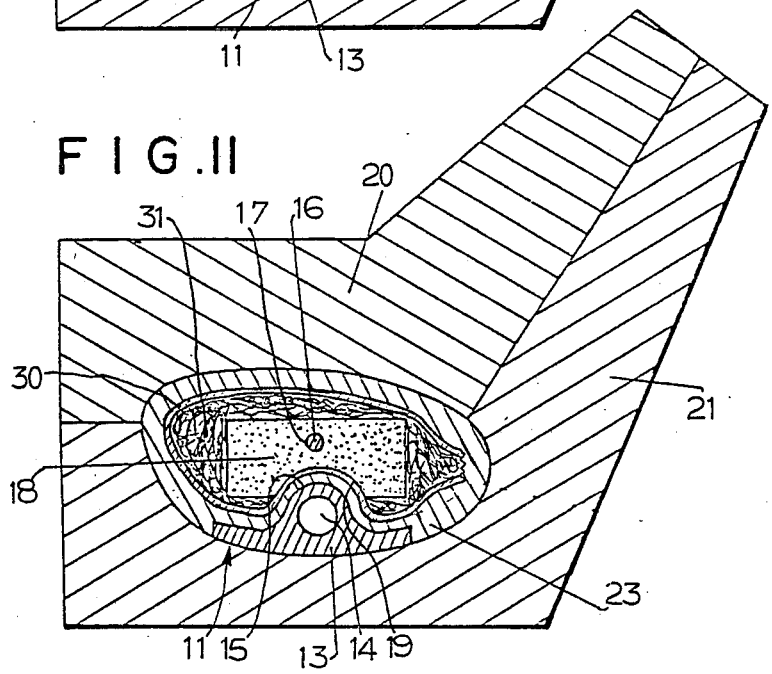
FIG. 11 is a perspective view of the reinforcement of carbon fiber fabric surrounding the head core.

As can be seen in FIGS. 10 and 11, the reinforcement 30 of carbon fiber fabric surrounds the head core 18 and extends onto the mandrel 22. Spaces between the core 18 and the mandrel 22 and the reinforcement 28 are filled with a filler 31 consisting of chopped strands, mats or fabrics of carbon fibers. A golf club head is molded in the mold in the same manner as in FIGS. 2 and 3 by positioning the sole member 11 and the core 18 and mandrel 22 covered with the reinforcement 30 of carbon fiber fabric and the filler 31 in the mold and depositing carbon fiber reinforced plastic around the reinforcement 30 and the mandrel 22. An extremely high content of carbon fibers in the head can be achieved by filling the space between the reinforcement and the core with the filler so that the strength of the head is remarkably increased at its junction to the head body. The neck portion is significantly strengthened by the reinforcement of the carbon fiber fabric extending from the head body to the neck portion.

We claim:

1. A golf club head comprising a shell of carbon fiber reinforced plastic, a core embedded in the center portion of said shell to reduce the head weight, a reinforcement of carbon fiber fabric surrounding the core and extending into the neck portion of the head to strengthen the head and the neck portion, a metal sole member including integral side and sole portions so arranged as to cover the side and the bottom of said shell, respectively, at least one projection of said metal sole member inserted into said core to position and retain it in said shell, and pocket means in said metal sole member for containing weights to be used for adjustment of the head or balance adjustment.

2. A golf club head as claimed in claim 1 wherein a tapered neck core with said reinforcement disposed therearound, is embedded in the neck portion of the head.

3. A golf club head as claimed in claim 1 wherein said reinforcement comprises separate elements covering the head core and the neck core and having overlapped ends at a junction of the neck portion to the head body.

4. A golf club head as claimed in claim 1 wherein said reinforcement comprises an integral element extending the head body to the neck portion and spaces between the head core and the reinforcement is filled with filler.

* * * * *